US009073232B2

(12) United States Patent
Schell

(10) Patent No.: US 9,073,232 B2
(45) Date of Patent: Jul. 7, 2015

(54) CHAIN GUARD AND CHAINSAW SYSTEM

(71) Applicant: Andreas Stihl AG & Co. KG, Waiblingen (DE)

(72) Inventor: Berthold Schell, Backnang (DE)

(73) Assignee: ANDREAS STIHL AG & CO. KG, Waiblingen (DE)

( * ) Notice: Subject to any disclaimer, the term of this patent is extended or adjusted under 35 U.S.C. 154(b) by 80 days.

(21) Appl. No.: 13/894,597

(22) Filed: May 15, 2013

(65) Prior Publication Data

US 2013/0305545 A1 Nov. 21, 2013

(30) Foreign Application Priority Data

May 15, 2012 (DE) ..... 10 2012 009 660

(51) Int. Cl.
*B27G 19/00* (2006.01)

(52) U.S. Cl.
CPC ..... *B27G 19/003* (2013.01)

(58) Field of Classification Search
USPC ..... 30/372, 381, 151, 286, 287, 296.1–298, 30/386, 383, 394; 206/349, 493, 564, 487; 244/220, 254; D3/220, 269; D8/65, 70
See application file for complete search history.

(56) References Cited

U.S. PATENT DOCUMENTS

| | | | | |
|---|---|---|---|---|
| 3,129,731 | A * | 4/1964 | Tyrrell | 30/151 |
| 4,143,460 | A * | 3/1979 | Shean | 30/382 |
| 4,369,575 | A | 1/1983 | Schurman | |
| 5,119,937 | A * | 6/1992 | Reynolds, Jr. | 206/349 |
| 2010/0229405 | A1 * | 9/2010 | Lank et al. | 30/382 |

OTHER PUBLICATIONS

European Search Report, Appl. No. 13002388.0-1709, Sep. 19, 2013, 4 pgs.

* cited by examiner

*Primary Examiner* — Ghassem Alie
(74) *Attorney, Agent, or Firm* — Paul D. Strain, Esq.; Strain & Strain PLLC

(57) ABSTRACT

The application relates to a chainsaw system and chain guard for a chainsaw with interchangeable cutting attachments of different lengths. The cutting attachments have cutting chains, and the chain guard includes an insertion opening for inserting a cutting attachment, at least two side walls for covering lateral surfaces of the cutting attachment, a front end opposite the insertion opening, a first latching depression formed in at least one side wall, and a second latching depression formed in at least one side wall at a distance closer toward the insertion opening with respect to the first latching depression. The first latching depression and the second latching depression each include an arcuate latching surface for latching in a form-fitting manner with a cutting chain of the cutting attachment, such that the latching is active in the direction of a longitudinal axis of the chain guard.

18 Claims, 4 Drawing Sheets

CHAIN GUARD AND CHAINSAW SYSTEM

CROSS-REFERENCE TO RELATED PATENT APPLICATIONS

This application is based upon and claims the benefit of priority from prior German Patent Application No. 10 2012 009 660.7, filed May 15, 2012, the entire contents of which are incorporated herein by reference in their entirety.

BACKGROUND

The application relates to a chain guard for a chainsaw with interchangeable cutting attachments of different lengths, said cutting attachments having cutting chains, wherein the chain guard comprises an insertion opening for inserting a cutting attachment, at least two side walls for covering lateral surfaces of the cutting attachment, a front end opposite the insertion opening, a first latching depression formed in at least one side wall, and a second latching depression formed in at least one side wall at a distance closer toward the insertion opening with respect to the first latching depression, wherein the first latching depression and the second latching depression each comprise an arcuate latching surface for latching in a form-fitting manner with a cutting chain of the cutting attachment, said latching being active in the direction of a longitudinal axis of the chain guard, and also to a chainsaw system having such a chain guard.

Motor-driven chainsaws of the usual construction comprise a cutting attachment having a cutting chain that is drivable by a drive motor of the chainsaw and having a guide rail, around the outer edge of which the cutting chain circulates. In order to transport or store the chainsaw, a chain guard is pushed onto the cutting attachment, said chain guard having in the usual construction an insertion opening for the cutting attachment and otherwise being in the form of a closed box, having two opposite side walls for covering lateral surfaces of the cutting attachment. As a result of the overall closed structure, with the exception of the insertion opening, of the chain guard, the cutting attachment as a whole is covered. As a result, the cutting attachment is first of all protected from external influences such as dirt or the like. In addition, the environment is also protected from dirt and oil and the sharp edges of the cutting chain are protected against soiling and damage.

In order for the chain guard to be seated reliably on the cutting attachment, the length of the chain guard should be matched to the length of the cutting attachment. However, for different tasks, cutting attachments having different lengths are used on the same basic unit of the chainsaw, for which reason a separate chain guard having an appropriate length is necessary for each cutting attachment that is used. This requires laborious handling on the part of the user, because he has to carry with him an appropriate large number of parts which require a corresponding storage space.

As an alternative, it is known to provide a chain guard having a shorter construction for a short cutting attachment as base unit, which can be adapted to longer cutting attachments by way of appropriate extension pieces. As a result, although the necessary storage space for parts to be carried along is reduced, the handling of said extensions is laborious in a similar manner to the handling of chain guards having different lengths. Furthermore, it has been shown in practice that the cutting attachment can get caught at the interface between the extension and the base chain guard during insertion or can even be inserted between the two parts.

The plugging of a too short chain guard onto a too long cutting attachment is disadvantageous because in this case the cutting attachment is not fully covered. Conversely, in the case of a too long chain guard on a too short cutting attachment, too little or no clamping force can be observed and this can lead, in conjunction with the poor fit, to the chain guard falling off.

It is one object of the application to develop a chain guard of the generic type in such a way that its range of use is expanded while having a good protective action and retaining force.

SUMMARY OF PREFERRED EMBODIMENTS

One object of the present application is achieved in one embodiment by way of a chain guard for various, interchangeable cutting attachments, having different lengths, of a chainsaw, wherein the chain guard has an insertion opening for the cutting attachment and is otherwise in the form of a closed box, having two opposite side walls for covering lateral surfaces of the cutting attachment, and wherein the chain guard has, with respect to its longitudinal axis, a front end opposite the insertion opening, wherein a first latching depression is formed in at least one side wall of the chain guard in the region of its front end and at least one second latching depression is formed at a distance from the first latching depression in the direction of the insertion opening, wherein the first latching depression and the second latching depression each have, towards the front end of the chain guard, an arcuate latching surface for latching in a form-fitting manner with cutting chains of the cutting attachments having different lengths, said latching being active in the direction of the longitudinal axis of the chain guard.

It is another object of the application to provide a chainsaw system which is simpler to handle during transport and during storage when cutting attachments having different lengths are used.

This particular object is achieved by one embodiment of a chainsaw system comprising a chainsaw having various, interchangeable cutting attachments having different lengths, a chain guard, wherein the chain guard comprises an insertion opening for inserting a cutting attachment, at least two side walls for covering lateral surfaces of the cutting attachment, a front end opposite the insertion opening, a first latching depression formed in at least one side wall, and a second latching depression formed in at least one side wall at a distance closer toward the insertion opening with respect to the first latching depression, wherein the first latching depression and the second latching depression each comprise an arcuate latching surface for latching in a form-fitting manner with a cutting chain of the cutting attachment, said latching being active in the direction of a longitudinal axis of the chain guard.

A further embodiment provides a chain guard for a chainsaw with interchangeable cutting attachments of different lengths, said cutting attachments having cutting chains, wherein the chain guard comprises an insertion opening for inserting a cutting attachment, at least two side walls for covering lateral surfaces of the cutting attachment, a front end opposite the insertion opening, a first latching depression formed in at least one side wall, and a second latching depression formed in at least one side wall at a distance closer toward the insertion opening with respect to the first latching depression, wherein the first latching depression and the second latching depression each comprise an arcuate latching surface for latching in a form-fitting manner with a cutting chain of the cutting attachment, said latching being active in the direction of a longitudinal axis of the chain guard.

Yet a further embodiment provides a chainsaw system comprising a chainsaw having various, interchangeable cutting attachments having different lengths, a chain guard, wherein the chain guard comprises an insertion opening for inserting a cutting attachment, at least two side walls for covering lateral surfaces of the cutting attachment, a front end opposite the insertion opening, a first latching depression formed in at least one side wall, and a second latching depression formed in at least one side wall at a distance closer toward the insertion opening with respect to the first latching depression, wherein the first latching depression and the second latching depression each comprise an arcuate latching surface for latching in a form-fitting manner with a cutting chain of the cutting attachment, said latching being active in the direction of a longitudinal axis of the chain guard.

In another embodiment, each arcuate latching surface is independently arranged at an average inclination angle ($\alpha$) with respect to the longitudinal axis of the chain guard. Optionally, the average inclination angle ($\alpha$) is in a range of 30° to 60°, inclusive. Optionally, the average inclination angle ($\alpha$) is at least approximately 45°.

In still another embodiment, the first latching depression and/or the second latching depression comprise an insertion slope arranged at an average inclination angle ($\beta$) with respect to the longitudinal axis of the chain guard. Optionally, the average inclination angle ($\beta$) is in a range of 5° to 20°, inclusive. Optionally, the average inclination angle ($\beta$) is at least approximately 10°.

According to another embodiment, it is provided that a first latching depression is formed in at least one side wall of the chain guard in the region of its front end and at least one second latching depression is formed at a distance from the first latching depression in the direction of the insertion opening, wherein the first latching depression and the second latching depression each have, towards the front end of the chain guard, an arcuate latching surface for latching in a form-fitting manner with the cutting chains of cutting attachments having different lengths, said latching being active in the direction of the longitudinal axis of the chain guard. In particular, opposing first latching depressions and second latching depressions are formed in each case in the two side walls of the chain guard. Preferably, they are arranged in a mirror-symmetrical manner with respect to one another.

In the case of further embodiment of the chain guard according to the present application and in the case of the chainsaw system according to the present application having such a chain guard, it is possible for at least two different cutting attachments having different lengths to be used, wherein the same chain guard can be used for both cutting attachments. In the case of the longer cutting attachment, latching of the chain guard to the cutting attachment takes place directly at the front end of the chain guard by means of the arcuate latching surface arranged there. In the process, a form fit is produced with the cutting chain. The form fit at the front end effects reliable holding of the chain guard, such that the latter cannot fall off in an undesired manner. The same applies, however, also in the case of the use of the same chain guard on a cutting attachment having a shorter length. In this case, the form-fitting latching is produced by means of the second latching depression of the chain guard and the second arcuate latching surface formed thereon. This likewise acts at the front end of the cutting attachment, although the latter is shorter than the first-mentioned cutting attachment and also shorter than the chain guard. In both cases, identically acting form-fitting latching takes effect, said latching acting by engaging behind the cutting chain in the direction of the longitudinal axis of the chain guard and as a result reliably ensuring unintentional pulling off of the chain guard irrespective of the choice of length of the cutting attachment. On account of the arc shape, in particular on account of the circular arc shape, of the latching surfaces, at least approximately planar abutment of these latching surfaces against the respective cutting chain is achieved where it is guided likewise in an arcuate manner around the front end of the guide rail. This ensures a reliable latching and clamping effect, avoiding local force peaks, which is otherwise impervious to soiling influences or the like.

In still another embodiment, it may suffice for the at least two latching depressions to be arranged on only one side wall of the chain guard or in an alternating manner. The arrangement in pairs and in particular in a mirror-symmetrical manner on both side walls results in the creation of symmetrical force conditions, which avoid tilting during plugging on and pulling off and as a result make handling easier. Furthermore larger or better defined clamping and latching forces can be produced as a result.

Advantageously, in yet a further embodiment, these latching surfaces have, with respect to the associated side wall, an inclination angle which is in a range of 30° to 60°, inclusive, and is, in particular, at least approximately 45°. The mentioned numerical values for the inclination angle ensure both a reliable latching action and also allow the chain guard to be pulled off in a desired manner actively brought about by the user using a defined manual force.

In still yet another embodiment, the first latching depression and/or the second latching depression have an insertion slope advantageously towards the insertion opening of the chain guard. The chain guard is preferably made of a resiliently flexible material, in particular of resiliently flexible plastics material. The insertion slope spreads the latching depressions, using the resilient flexibility of the chain guard during pushing onto the cutting attachment, such that the chain guard can be pushed on with little and uniform manual force without tilting or catching.

In another embodiment, the insertion slope has, with respect to the associated side wall, an average inclination angle which is expediently in a range of 5° to 20°, inclusive, and is, in particular, at least approximately 10°. In this case, it may be expedient for the insertion slope to have a rectilinear profile in the insertion direction. Advantageously, however, it is formed in a concavely curved manner in the insertion direction. Good centering action and moderate manual forces are combined with one another as a result.

In another preferred development, the chain guard according to the invention has, starting from its insertion opening, an insertion funnel that narrows the cross section of the chain guard. This makes it easier to push the chain guard onto the cutting attachment.

In a preferred embodiment, centering depressions for the cutting attachment are formed in at least one side wall, and preferably both side walls, of the chain guard in the region of its insertion opening, wherein the centering depressions are provided for lateral abutment against the lateral surfaces of the guide rail of the cutting attachment. In addition to the form-fitting latching at the front end, the chain guard is also spatially fixed at its rear end that is located in the region of the insertion opening, such that the chain guard retains its provided position, in a manner free of wobbling and tilting and cannot slide off as easily in an unintentional manner. In this case, it may be expedient for the insertion funnel, starting from the insertion opening, to extend as far as the centering depression. In this case the insertion funnel also assumes the spreading function for the centering depressions, as was also described previously in conjunction with the insertion slopes. As a result of the direct abutment of the insertion funnel against the centering depression, the installation space is used optimally, such that a distance that is as large as possible between the latching depressions and the centering depressions is produced. As a result, the chain guard maintains its spatial fixing along a stretch that is as long as possible, thereby benefiting positional accuracy.

The cutting chains have a width, while a free spacing remains between opposing first latching depressions and second latching depressions, said free spacing preferably being smaller than the width of the cutting chain. As a result, form-fitting latching of the latching depressions with the respective cutting chain of the respectively used guide rail is ensured. In particular, it may be expedient in this case for the mentioned free spacing between the latching depressions also to be smaller than the thickness of the guide rail. The above-described form-fitting latching action is then supplemented by a lateral clamping action which is produced by the elastically resilient pre-loaded clamping and frictional abutment of the latching depressions against the lateral surfaces of the guide rail.

The latching surfaces have, in plan view from the side onto the associated side wall, preferably a second radius which is less than or equal to a first radius of the free end on the guide rail for deflecting the respective cutting chain. This makes a contribution to the planar and soiling-tolerant latching abutment between the latching surface and the cutting chain.

Further objects, features, and advantages of the present application will become apparent form the detailed description of preferred embodiments which is set forth below, when considered together with the figures of drawing.

BRIEF DESCRIPTION OF THE DRAWINGS

Further exemplary embodiments of the invention are described in more detail in the following text by way of the drawing, in which.

DETAILED DESCRIPTION OF PREFERRED EMBODIMENTS

Figure 1:
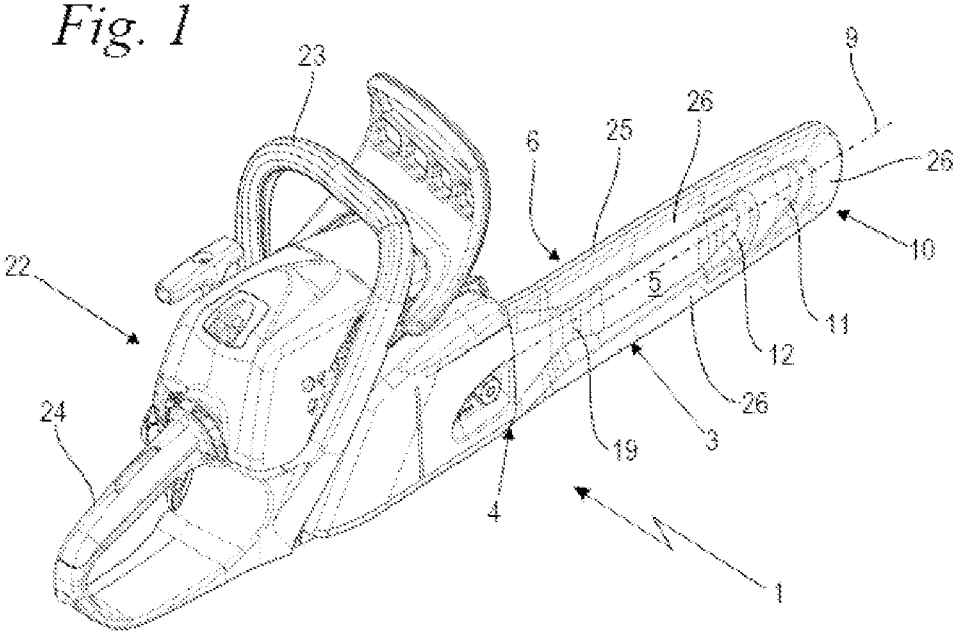
FIG. 1 shows a perspective overview illustration of a chainsaw system according to the invention having a chainsaw and also having a chain guard for interchangeable cutting attachments.

FIG. 1 shows a perspective illustration of an embodiment of a chainsaw system embodied according to the present application, which comprises a chainsaw 1 having various, interchangeable cutting attachments 2, 2' having different lengths L, L', which are illustrated in FIGS. 2 to 8. Furthermore, the chainsaw system has a chain guard 3, which, when the chainsaw 1 is not being used, i.e. during transport and during storage, can be pushed onto the cutting attachment 2, 2' (FIGS. 2 to 8) mounted in each case on the chainsaw 1.

The chainsaw 1 has a motor housing 22, in which a drive motor (not illustrated) is arranged. Furthermore, a front handle 23 and a rear handle 24 for guiding the chainsaw 1 during sawing are arranged on the motor housing 22.

The chain guard 3 is in the form of a box which is closed all the way round and is made of plastics material having a wall thickness of about 1.5 mm and has two opposing side walls 5, 6 and a circumferential wall 25 encircling the narrow side. As a single exception to the otherwise entirely closed structure, an insertion opening 4 is provided on the chain guard 3 on its side facing the motor housing 22, it being possible for the chain guard 3 to be pushed onto the cutting attachment 2, 2' (FIGS. 2 to 8), mounted in each case on the chainsaw 1, by means of said insertion opening that the edge of the insertion opening 4 of the chain guard 3 preferably rests at least approximately without a gap against the housing of the chainsaw 1, as a result of which the respectively mounted cutting attachment 2, 2' (FIGS. 2 to 8) is covered at least approximately completely by means of the chain guard 3.

Figure 2:
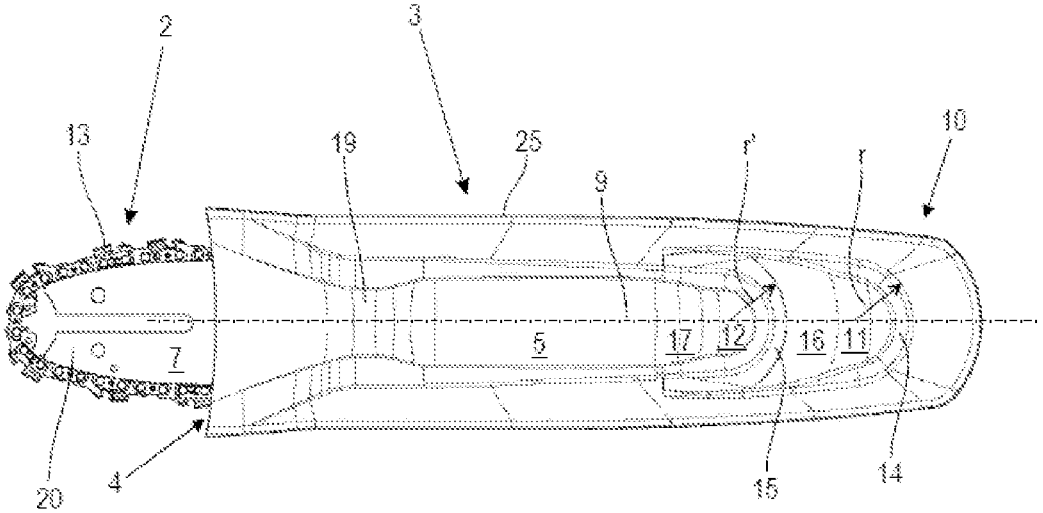
FIG. 2 shows a side view of one of at least two different cutting attachments of the chainsaw system according to FIG. 1, with a plugged-on chain guard, wherein geometric details for configuring latching depressions and centering depressions are discernible.
Figure 3:
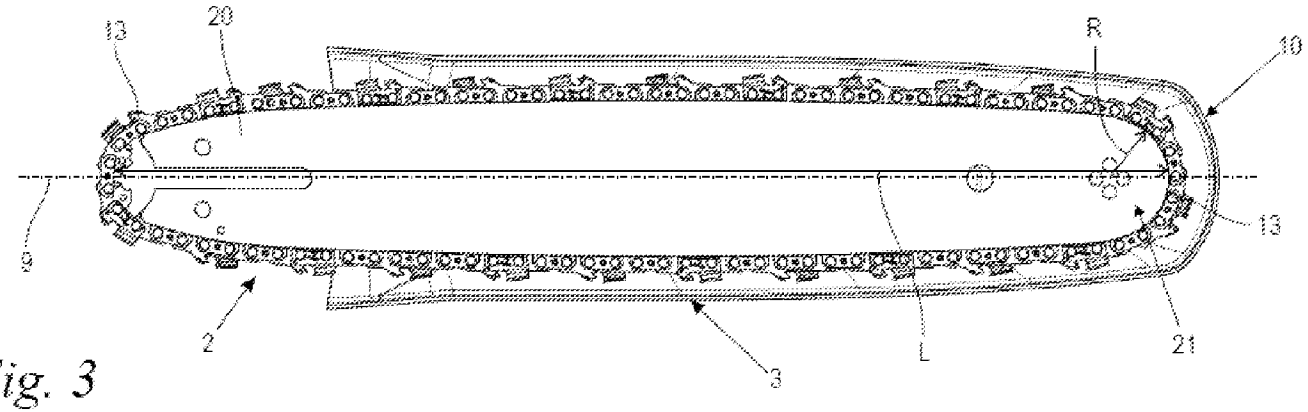
FIG. 3 shows the arrangement according to FIG. 2 with an illustration of the chain guard in longitudinal section and with details for configuring the cutting attachment in a long construction.
Figure 4:
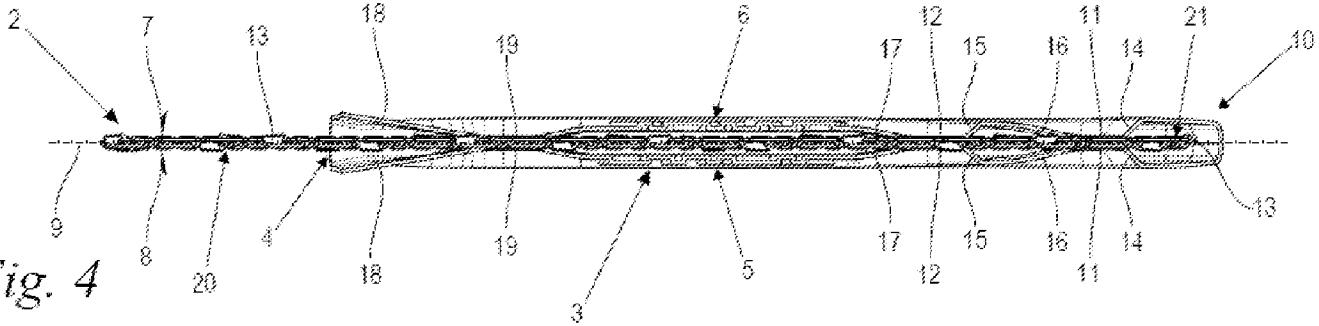
FIG. 4 shows a plan view of the arrangement according to FIG. 3, with the chain guard in section in order to illustrate the interaction between the latching depressions or centering depressions and the cutting attachment.
Figure 6:
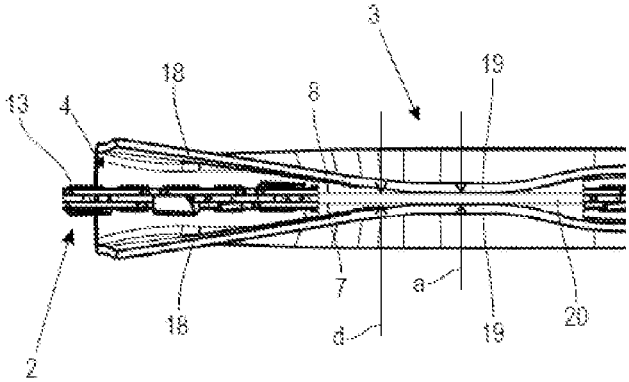
FIG. 6 shows an enlarged detail illustration of the arrangement according to FIG. 4 in the region of the insertion funnel and of the centering depressions with details regarding the geometric configurations thereof.
Figure 7:
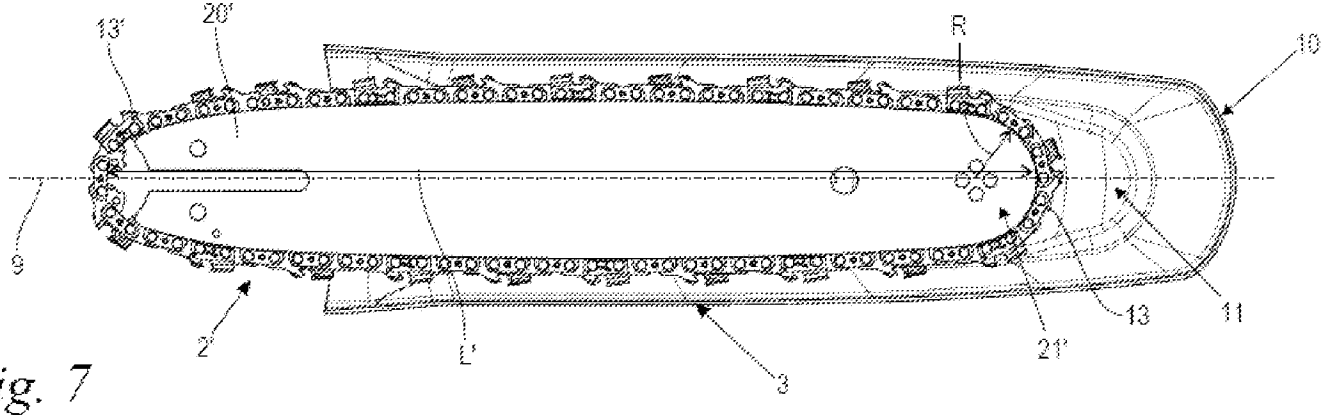
FIG. 7 shows the arrangement according to FIG. 3, with an alternatively used shorter cutting attachment.
Figure 8:
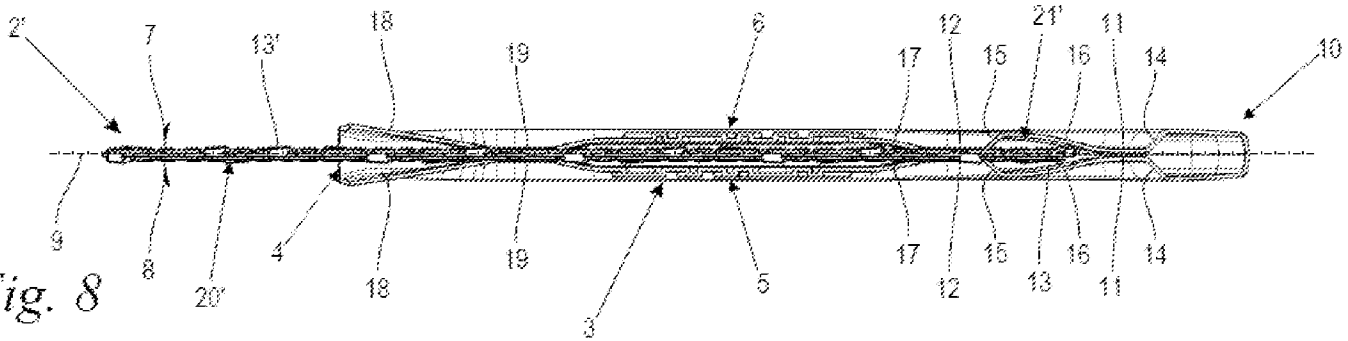
FIG. 8 shows the arrangement according to FIG. 4 with the shorter cutting attachment according to FIG. 5 in interaction with the rear latching depressions of the pushed-on chain guard.

It can be seen from viewing FIGS. 2 to 8 together that the various cutting attachments 2, 2' each comprise a guide rail 20, 20' having cutting chains 13, 13' running around their circumferential edges. During operation, the cutting chains 13, 13' are driven in circulation by the drive motor (not illustrated) of the chainsaw 1 (FIG. 1). In the illustration according to FIG. 1, it can be seen that, in a manner corresponding to the cutting chains 13, 13', an encircling receiving channel 26 having a suitable width for receiving the cutting chains 13, 13' is formed in the region of the circumferential wall 25 of the chain guard 3. Compared with this encircling receiving channel 26, the side walls 5, of the chain guard 3 are offset inwardly towards the interior thereof, and cover lateral surfaces 7, 8 of the respective guide rail 20, 20' (FIGS. 4, 8).

The chain guard 3 extends along a longitudinal axis 9 and has, with respect to its longitudinal axis 9, a front end 10 opposite the insertion opening 4, as is illustrated for example in FIGS. 1, 2. It can be seen in particular in the perspective illustration according to FIG. 1 that a first latching depression 11 is formed in at least one side wall 5, 6 of the chain guard 3, in the region of its front end 10. Furthermore, in at least one side wall 5, 6 at least one second latching depression 12 is formed in the direction towards the insertion opening 4, i.e. behind the first latching depression 11. In addition, further latching depressions for further cutting attachments having different lengths may also be provided. It can be seen in particular from the enlarged detail illustration according to FIG. 5 that in each case opposing pairs of first latching depressions 11 and second latching depressions 12 are formed in the two side walls 5, 6 of the chain guard 3 and are arranged in this case in a mirror-symmetrical manner with respect to one another. In addition, a pair of mirror-symmetrically opposite centering depressions 19 are also formed in the side walls 5, 6, close to the insertion opening 4. The term depressions selected here and in the following text relates to the fact that the mentioned depressions, i.e. the latching depressions 11, 12 and the centering depressions, 19, bulge inwardly towards the interior of the chain guard 3, starting from the side walls 5, 6 of the chain guard 3.

Details of the latching depressions 11, 12 illustrated in FIG. 1 can be seen in the lateral plan view according to FIG. 2, according to which the front latching depression 11 located close to the front end 10 comprises a latching surface 14 on its side directed towards the front end 10 and an insertion slope 16 on its rear side directed towards the insertion opening 4. In a similar manner, the rear latching depression 12 directly adjoining the insertion slope 16 rearward towards the insertion opening 4 is provided with a front latching surface 15 and a rear insertion slope 17. The two latching surfaces 14, 15 are configured in an arcuate manner, more precisely in the form of a circular arc having an identical second radius r or r'. On account of the above-described mirror symmetry, the same also applies for the latching depressions 11, 12 in the opposite side wall 6, as can be seen for example in FIG. 5.

FIG. 3 shows a side view of the arrangement according to FIG. 2, in which the chain guard 3 is illustrated in section. The chain guard 3 is in this case, pushed onto a first cutting attachment 2 having a length L. The cutting attachment 2, or the guide rail 20 thereof, has a free end 21. The length of the chain guard is dimensioned such that the chain guard 3, in the plugged-on state according to FIG. 1, extends by way of its outer or front end 10 immediately as far as the free end 21 of the guide rail 20 and the cutting chain 13 deflected there with a first radius R.

FIG. 7 illustrates the arrangement according to FIG. 3, wherein, compared with the cutting attachment 2 according to FIG. 3, a shorter cutting attachment 2' is mounted as an alternative on the chainsaw 1 (FIG. 1). The same chain guard 3 is pushed here onto the shorter cutting attachment 2' and assumes in the process the position according to FIG. 1. It can be seen that the free end 21' of the shorter guide rail 20' having the cutting chain 13' does not extend as far as the front end 10 of the chain guard 3, but comes to lie, with respect to the longitudinal axis 9 of the chain guard 3, at a distance from the front end 10 behind the first latching depression 11. As far as the other features and reference signs are concerned, the shorter cutting attachment 2' corresponds to the longer cutting attachment 2 according to FIG. 3, wherein the shorter cutting chain 13' is also deflected with the same first radius R at the free end 21' of the guide rail 20'.

FIG. 4 shows a plan view of the arrangement according to FIG. 3, wherein the chain guard 3 is illustrated in section. In this view, the chain guard 3 is constructed entirely symmetrically with respect to its longitudinal axis 9. This has already been described above for the latching depressions 11, 12 having the associated latching surfaces 14, 15 and insertion slopes 16, 17 and also applies for the pair of opposing centering depressions 19 in the side walls 5, 6. The two centering depressions 19 are located at the rear end of the chain guard 3, close to the insertion opening 4, at a distance from the latching depressions 11, 12 with respect to the longitudinal axis 9 and the front end 10. Furthermore, the chain guard 3, starting from its insertion opening 4, has an insertion funnel 18 that narrows the cross section of the chain guard 3, said insertion funnel extending from the insertion opening 4 as far as the centering depressions 19.

As can also be seen in FIG. 4, the long cutting attachment 2 according to FIG. 3 has been pushed into the chain guard 3. Expressed the other way round, the chain guard 3 has been pushed onto the cutting attachment 2 into the position according to FIGS. 1 and 3. In this case, the free end 21 of the cutting attachment 2 is first of all pushed into the insertion funnel 18 and then guided through between the centering depressions 19, the second latching depressions 12 and the first latching depressions 11, as far as the front end 10 of the chain guard 3.

Figure 5:
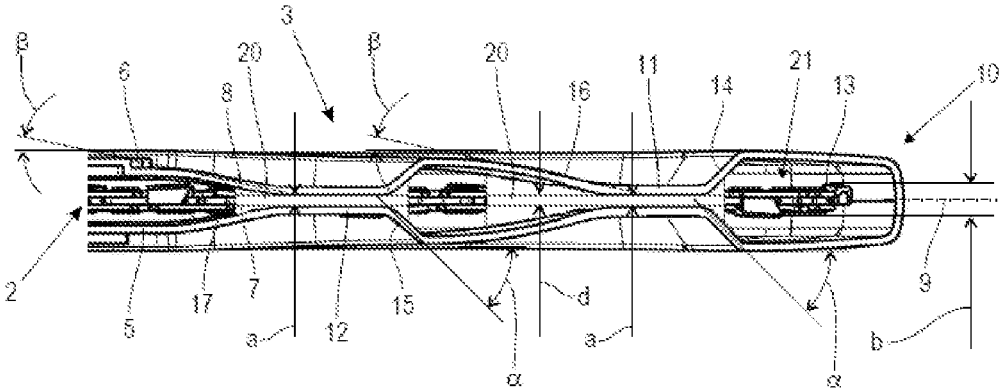
FIG. 5 shows an enlarged detail illustration of the arrangement according to FIG. 4 in the region of its latching depressions with details regarding the geometric configuration thereof.

FIG. 5 shows an enlarged detail illustration of the arrangement according to FIG. 4 in the region of the front end 10 or the free end 21, wherein, for the sake of clarity, the cutting chain 13 is illustrated only partially, in order to make a plan view of the guide rail 20 in the remaining portions visible.

It can be seen that the cutting chain 13 has a width b, while the guide rail 20 has a smaller thickness d compared thereto. A free spacing a remains between the opposing first latching depressions 11 and also between the opposing second latching depressions 12. This free spacing a is smaller than the width b of the cutting chain 13, and so the front, first latching depressions 11 engage behind the cutting chain 13 in a form-fitting latching manner in the region of the free end 21 of the cutting attachment 2 in the direction of the longitudinal axis 9, such that the chain guard 3 cannot fall off towards the front by itself in the direction of the longitudinal axis 9. On account of the resiliently flexible plastics material of the chain guard 3, the latter, however, can be pulled off towards the front over the cutting chain 13 or the free end 21 by way of its latching depressions 11, 12 and also centering depressions 19 (FIGS. 4, 6). In the secured and latched state according to FIGS. 3, 4 and 5, however, the latching surfaces 14 with their second radius r which are illustrated in FIG. 2 and are assigned to the first latching depressions 11 rest, at the free end 21, internally in a latching and planar manner against the cutting chain 13 with the first radius R (FIG. 3), thereby ensuring that the chain guard 3 is secured in position in the desired form-fitting manner on the cutting attachment 2. The second radius r of the latching surface 14 (FIG. 2) is in this case advantageously less than or equal to the first radius R of the free end 21 according to FIG. 3, as a result of which an at least approximately planar abutment between the latching surface 14 (FIG. 2), and the cutting chain 13 is brought about in the region of the free end 21 (FIGS. 3 to 5).

Optionally, the spacing a between the latching depressions 11 and also between the latching depressions 12 can also be somewhat smaller than the thickness d of the guide rail 20. As a result, a clamping action is achieved in addition to the above-described latching form fit, said clamping action being brought about by elastically resilient contact pressure, with preloading, of the latching depressions 11, 12 against the lateral surfaces 7, 8 of the guide rail 20.

It can also be seen in FIG. 5 that the latching surfaces 14, 15, with respect to the side walls 5, 6 assigned to them, each have an inclination angle $\alpha$ which is advantageously in a range of 30° to 60°, inclusive, and in the preferred exemplary embodiment shown is at least approximately 45°. The insertion slopes 16, 17, starting from the latching depressions 11, 12 and extending as far as the insertion opening 4 of the chain guard 3, can have a rectilinear or convexly curved profile with respect to the longitudinal axis in the longitudinal section shown, but in the preferred exemplary embodiment shown are concavely curved. The terms "convex" and "concave" selected here refer to the shape of curvature or bulge on the inner side of the chain guard 3, i.e. where the insertion slopes 16, 17, exert their function as an insertion aid for the respective cutting attachment 2, 2'. In this case, the insertion slopes 16, 17 have, with respect to the side walls 5, 6 assigned to them in each case, an average inclination angle $\beta$, which is advantageously in a range of 5° to 20°, inclusive, and in the preferred exemplary embodiment shown is at least approximately 10°.

FIG. 6 shows a detail illustration of the arrangement according to FIG. 4 in the region of the insertion opening 4 with details for configuring the centering depressions 19 and the insertion funnel 18. The centering depressions 19 are provided for abutment against one of the lateral surfaces 7, 8 or against both lateral surfaces 7, 8 of the guide rail 20, as a result of which they effect centering of the chain guard 3 with respect to the respectively inserted cutting attachment 2, 2' in the lateral direction or in the direction of the thickness of the guide rail 20. Between the two centering depressions 19 there remains a free spacing a, for which the same applies as for the free spacing a between the latching depressions 11 or latching depressions 12 according to FIG. 5. Here, too the free spacing a can optionally be larger, the same size as or slightly smaller than the thickness d of the guide rail 20, such that at least in the latter case, a clamping effect is produced between the centering depressions 19 and the lateral surfaces 7, 8 of the guide rail 20.

In each case, the free spacing a between the two centering depressions 19 is smaller than the width b (FIG. 5) of the cutting chain 13, 13', so that the cutting chain 13, 13' cannot be pushed directly forward to the associated latching depression 11, 12 during the insertion of the cutting attachment 2, 2' into the chain guard 3. Rather, the cutting chain 13, 13' is first of all oriented centrally with respect to the centering depressions 19 during the insertion operation by means of the insertion funnel 18. Upon further insertion, the insertion funnel 18 spreads the chain guard 3 in the region of the centering depressions 19. As a result, the actual spacing between the centering depressions 19, compared with their free, undisturbed spacing a, is enlarged by elastic deformation to such an extent that the cutting attachment 2, 2' with its respective cutting chain 13, 13' can be pushed through between the centering depressions 19. After the wider cutting chain 13, 13' has passed through, the centering depressions 19 snap elastically back to their free, undisturbed spacing a, coming to rest against the side walls 7, 8 and exert their above-described centering function. Furthermore, it can be seen in FIG. 6 that the insertion funnel 18 merges directly into the centering depressions 19. However, it may also be expedient for a spacing to remain between the insertion funnel 18 and the centering depressions 19 in the longitudinal direction.

FIGS. 7 and 8 show the arrangement according to FIGS. 3 and 4, wherein the same chain guard 3 has been pushed onto a cutting attachment 2' having a shorter length L' compared with FIGS. 3 and 4. The cutting chain 13' has been adapted in terms of its length to the shorter length L' of the guide rail 20', but is deflected in the same way around the free end 21' with the same first radius R.

It can be seen from viewing FIGS. 7 and 8 together that, as a result of the shorter length L', it is not the front, first latching depression 11, but rather the second, rear latching depression 12 that comes to lie, with the chain guard 3 otherwise in the same position latching behind the cutting chain 13', at the free end 21', located further back, of the guide rail 20' or of the cutting attachment 2' and holds the chain guard 3 there in a latching manner against the shorter cutting attachment 2'. Since, in accordance with the above description, the second, rear latching depression 12 is configured geometrically in a manner similar to the first, front latching depression 11, and since, furthermore, the spacing between the latching depressions 11, 12 is the same as the difference between the lengths L, L' of the cutting attachments 2, 2', the same conditions are formed here for securing in position as are described in conjunction with FIGS. 3 to 6. The only difference is that the latching hold in the longitudinal direction is not brought about by the front latching surfaces 14 but by the rear latching surfaces 15. Otherwise, the conditions are the same. This applies in particular also for the clamping action between the rear latching depressions 12 against the lateral surfaces, 7, 8 of the guide rail 20' and also for the centering action between the centering depressions 19 in the region of the insertion funnel 18.

Unless described to the contrary, the same features and reference signs as in the arrangement according to FIGS. 2 to 6 apply otherwise for the arrangement according to FIGS. 7 and 8.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

The invention claimed is:

1. A chain guard for a chainsaw, wherein the chainsaw comprises a first cutting attachment and a second cutting attachment, wherein the first cutting attachment comprises a first cutting chain and a first free end, wherein the second cutting attachment comprises a second cutting chain and a second free end, wherein the first cutting attachment and second cutting attachment have different lengths, wherein the chain guard comprises:

an insertion opening for inserting the first cutting attachment or the second cutting attachment, at least two side walls for covering lateral surfaces of the first cutting attachment or the second cutting attachment, a circumferential wall, a front end opposite the insertion opening, a first latching depression formed in at least one side wall in the region of the front end of the at least one side wall, and a second latching depression formed in at least one side wall at a distance closer toward the insertion opening with respect to the first latching depression, a receiving channel for receiving the first cutting chain or the second cutting chain, wherein the chain guard encloses a space bounded by the two side walls, the circumferential wall, and the front end and has an opening at the insertion opening, wherein the first latching depression comprises arcuate latching surface for latching in a form-fitting manner with the first free end of the first cutting attachment, said latching being active in the direction of a longitudinal axis of the chain guard, wherein the first latching depression comprises a portion of the receiving channel and accommodates the first cutting chain with lateral play, wherein the second latching depression comprises an arcuate latching surface for latching in a form-fitting manner with the second free end of the second cutting attachment, said latching being active in the direction of a longitudinal axis of the chain guard, wherein the second latching depression comprises a portion of the receiving channel and accommodates the second cutting chain with lateral play.

2. The chain guard according to claim 1, wherein at least two opposing first latching depressions are formed in the side walls, and wherein at least two opposing second latching depressions are formed in the side walls.

3. The chain guard according to claim 2, wherein the opposing first latching depressions are arranged in a mirror-symmetrical manner with respect to one another, and wherein the opposing second latching depressions are arranged in a mirror-symmetrical manner with respect to one another.

4. The chain guard according to claim 1, wherein the arcuate latching surface comprises a circular arc.

5. The chain guard according to claim 4, wherein each arcuate latching surface is independently arranged at an average inclination angle ($\alpha$) with respect to the longitudinal axis of the chain guard, wherein the average inclination angle ($\alpha$) is in a range of 30° to 60°, inclusive.

6. The chain guard according to claim 5, wherein the average inclination angle ($\alpha$) is at least approximately 45°.

7. The chain guard according to claim 1, wherein the first latching depression and/or the second latching depression comprise an insertion slope arranged at an average inclination angle ($\beta$) with respect to the longitudinal axis of the chain guard.

8. The chain guard according to claim 7, wherein the average inclination angle ($\beta$) is in a range of 5° to 20°, inclusive.

9. The chain guard according to claim 8, wherein the average inclination angle ($\beta$) is at least approximately 10°.

10. The chain guard according to claim 7, wherein the insertion slope is concavely curved with respect to the longitudinal axis.

11. The chain guard according to claim 1, wherein the chain guard comprises an insertion funnel that is wider toward the insertion opening and narrower toward the front end.

12. The chain guard according to claim 1, comprising a centering depression formed in at least one side wall of the chain guard in the region of the insertion opening of the chain guard, wherein the centering depression is designed to laterally abut the lateral surface of the cutting attachment.

13. The chain guard according to claim 12, comprising two centering depressions, each formed on opposite side walls of the chain guard.

14. The chain guard according to claim 11, wherein the insertion funnel spans the region of the chain guard between the insertion opening and the centering depression.

15. A chainsaw system comprising:

a chainsaw having a first cutting attachment and a second cutting attachment, wherein the first cutting attachment and the second cutting attachment are interchangeable and have different lengths, a chain guard, wherein the chain guard comprises:

an insertion opening for inserting a cutting attachment, at least two side walls for covering lateral surfaces of the cutting attachment, a front end opposite the insertion opening, a first latching depression formed in at least one side wall, and a second latching depression formed in at least one side wall in the region of the front end of the side wall at a distance closer toward the insertion opening with respect to the first latching depression, wherein the chain guard encloses a space bounded by the two side walls and the front end and has an opening at the insertion opening, wherein the first latching depression comprises an arcuate latching surface for latching in a form-fitting manner with a cutting chain of the first cutting attachment in the region of the front end of the first cutting attachment, said latching being active in the direction of a longitudinal axis of the chain guard, wherein the second latching depression comprises an arcuate latching surface for latching in a form-fitting manner with a cutting chain of the second cutting attachment in the region of the front end of the second cutting attachment, said latching being active in the direction of a longitudinal axis of the chain guard, wherein the chain guard at least approximately covers the entire first cutting attachment or the entire second cutting attachment when the first cutting attachment or the second cutting attachment is latched in the first cutting depression or the second cutting depression, respectively.

16. The chainsaw system according to claim 15, wherein the cutting attachments comprise guide rails with circumferential cutting chains, wherein the cutting chains have a width, wherein a first free spacing is bounded between the two first latching depressions, wherein a second free spacing is bounded between the two second latching depressions, and wherein said first free spacing and second free spacing are each independently smaller than the width of the cutting chain.

17. The chainsaw system according to claim 16, wherein the guide rails have a thickness, and wherein the first free spacing and second free spacing are each independently smaller than the thickness of the guide rail.

18. The chainsaw system according to claim 16, wherein the guide rails each have a free end for deflecting the cutting chain, wherein the free end has a first radius in plan view from the side, wherein the first latching surface and second latching surface each independently have a second radius in a plan view from the side onto the associated side wall, and wherein the second radius is less than or equal to the first radius.

* * * * *